US009230791B2

(12) United States Patent
Kim et al.

(10) Patent No.: US 9,230,791 B2
(45) Date of Patent: Jan. 5, 2016

(54) ANION GENERATING AND ELECTRON CAPTURE DISSOCIATION APPARATUS USING COLD ELECTRONS

(75) Inventors: Hyun Sik Kim, Daejeon (KR); Seung Young Kim, Daejeon (KR); Mo Yang, Daejeon (KR)

(73) Assignee: KOREA BASIC SCIENCE INSTITUTE, Daejeon (KR)

( * ) Notice: Subject to any disclaimer, the term of this patent is extended or adjusted under 35 U.S.C. 154(b) by 0 days.

(21) Appl. No.: 14/358,809

(22) PCT Filed: Nov. 28, 2011

(86) PCT No.: PCT/KR2011/009105

§ 371 (c)(1),
(2), (4) Date: Sep. 3, 2014

(87) PCT Pub. No.: WO2013/081195

PCT Pub. Date: Jun. 6, 2013

(65) Prior Publication Data

US 2014/0367568 A1 Dec. 18, 2014

(51) Int. Cl.

| | |
|---|---|
| ***H01J 49/08*** | (2006.01) |
| ***H01J 49/10*** | (2006.01) |
| ***H01J 43/04*** | (2006.01) |
| ***H01J 49/00*** | (2006.01) |
| ***H01J 49/42*** | (2006.01) |

(Continued)

(52) U.S. Cl.

CPC ..... *H01J 49/08* (2013.01); *H01J 27/028* (2013.01); *H01J 43/04* (2013.01); *H01J 49/0045* (2013.01); *H01J 49/0054* (2013.01); *H01J 49/10* (2013.01); *H01J 49/147* (2013.01); *H01J 49/426* (2013.01); *H01J 43/246* (2013.01); *H01J 49/38* (2013.01)

(58) Field of Classification Search

CPC ..... H01J 49/08; H01J 43/246; H01J 49/147; H01J 2237/2444; H01J 43/04; H01J 49/0054; H01J 49/10; H01J 49/38; H01J 49/4245; H01J 27/028; G01N 27/64

See application file for complete search history.

(56) References Cited

U.S. PATENT DOCUMENTS 5,659,170 A * 8/1997 Da Silveira et al. ..... 250/287
5,852,295 A * 12/1998 Da Silveira et al. ..... 250/423 R (Continued)

FOREIGN PATENT DOCUMENTS

JP 2001-006605 1/2001
JP 2003-203581 7/2003

(Continued)

*Primary Examiner* — Michael Logie
(74) *Attorney, Agent, or Firm* — Weiss & Moy, P.C.; Jeffrey D. Moy

(57) ABSTRACT

An anion generating and electron capture dissociation apparatus using cold electrons, which comprises a cold electron generation module configured to generate a large quantity of cold electrons from ultraviolet photons radiated into a mass spectrometer vacuum chamber which is in a high vacuum state has a plurality of ultraviolet diodes configured to emit the ultraviolet photons in the mass spectrometer vacuum chamber. Micro-channel plate (MCP) electron multiplier plates induce and amplify initial electron emissions of the ultraviolet photons from the ultraviolet diodes, and generate a large quantity of electron beams from a rear plate. An electron focusing lens is configured to focus the electron beams amplified through the MCP electron multiplier plates. A grid is configured to adjust energy and an electric current of the electron beams together with the electron focusing lens.

5 Claims, 2 Drawing Sheets

(51) Int. Cl.

| | |
|---|---|
| ***H01J 27/02*** | (2006.01) |
| ***H01J 49/14*** | (2006.01) |
| *H01J 43/24* | (2006.01) |
| *H01J 49/38* | (2006.01) |

(56) References Cited

U.S. PATENT DOCUMENTS

| | | | | |
|---|---|---|---|---|
| 6,239,549 | B1 * | 5/2001 | Laprade | 313/533 |
| 2003/0183774 | A1 * | 10/2003 | Tajima | 250/423 P |
| 2007/0263223 | A1 * | 11/2007 | Hirai et al. | 356/450 |
| 2008/0164798 | A1 * | 7/2008 | Baik et al. | 313/103 R |
| 2010/0084549 | A1 * | 4/2010 | Ermakov et al. | 250/283 |
| 2011/0234233 | A1 * | 9/2011 | Brucker | 324/460 |
| 2013/0120894 | A1 * | 5/2013 | van Amerom et al. | 361/230 |
| 2014/0124662 | A1 * | 5/2014 | Yang et al. | 250/288 |
| 2014/0339423 | A1 * | 11/2014 | Kim et al. | 250/288 |

FOREIGN PATENT DOCUMENTS

| | | |
|---|---|---|
| JP | 2006-344444 | 12/2006 |
| KR | 10-0659261 | 12/2006 |

* cited by examiner

ANION GENERATING AND ELECTRON CAPTURE DISSOCIATION APPARATUS USING COLD ELECTRONS

TECHNICAL FIELD

The present invention relates to an electron capture dissociation (ECD) and negative ionization apparatus which is an apparatus for injecting an cold electron beam into an ion trap of a Fourier transform ion cyclotron resonance mass spectrometer (FT-ICR MS), and more particularly, to an anion generating and electron capture dissociation apparatus using cold electrons which controls energy of an electron beam injected into an ion trap to generate anions in the ion trap, or fragments cations having multiple charges into fragment ions.

BACKGROUND ART

Generally, an ECD method is used for a Tandem mass spectrometry (MS/MS) in which peptide or protein ions having multiple positive charges are confined in an ion trap, an electron beam is injected into the ion trap, and multiple ionized molecules are coupled with electrons in the ion trap and dissociated. Further, the electrons having low energy are coupled with neutral molecules in an FT-ICR ion trap, thereby forming anions.

A trial operation of a conventional ECD apparatus should be conducted a day ahead in order to operate the apparatus, and thus a high vacuum state having a high vacuum environment of $1\times10^{-7}$ to $1\times10^{-11}$ torr should be prepared in the FT-ICR ion trap. Even in the case of an operation of the day, a preheating time of at least about 2 hours is required until a change in pressure due to heat generated in a heating part when generating thermoelectrons is stabilized.

Further, since a high electric current should be applied in order to heat a filament, a lot of power is consumed, and thus it is difficult to precisely control energy and an electric current in the thermoelectrons heated to a high temperature. Further, when the neutral molecules are coupled with the electrons and generate the anions, it is advantageous for the electrons to have lower energy.

DISCLOSURE

Technical Problem

The present invention is directed to providing an anion generating and electron capture dissociation apparatus using cold electrons, which uses a micro-channel plate (MCP) electron multiplier plate to generate an electron beam for ionization within an ion trap of a Fourier transform ion cyclotron resonance mass spectrometer (FT-ICR MS), injects ultraviolet photons emitted from an ultraviolet diode to the front surface of the MCP electron multiplier plate to obtain the electron beam in which the electrons are amplified by a factor of million, uses an electron focusing lens to focus and inject the electron beam into the trap, uses the ultraviolet diode and the MCP to generate the electron beam of which an emission time is precisely controlled with low temperature and low power, installs the electron focusing lens to focus the generated electron beam, and generates an ECD reaction by coupling electrons to molecules having multiple positive charges using a low energy electron beam emitting apparatus for the negative ionization of neutral molecules in the ion trap of the mass spectrometer.

Technical Solution

One aspect of the present invention provides an anion generating and electron capture dissociation apparatus using cold electrons, which comprises a cold electron generation module configured to generate a large quantity of cold electrons from ultraviolet photons radiated into a mass spectrometer vacuum chamber which is in a high vacuum state, including a plurality of ultraviolet diodes configured to emit the ultraviolet photons in the mass spectrometer vacuum chamber, micro-channel plate (MCP) electron multiplier plates which induce and amplify initial electron emission of the ultraviolet photons from the ultraviolet diodes, and generate a large quantity of electron beams from a rear plate, an electron focusing lens configured to focus the electron beams amplified through the MCP electron multiplier plates, and a grid configured to adjust energy and an electric current of the electron beams together with the electron focusing lens.

The ultraviolet diode and the MCP electron multiplier plate may be one closed module, each of which is provided in one or plural.

Advantageous Effect

The anion generating and electron capture dissociation apparatus using the cold electrons according to the present invention can be used as the cold electron generation device for the FT-ICR MS and the ion trap MS, can be applied to the negative ionization device and the ECD device, and then can be used as the negative ionization device and the ECD device which can focus a predetermined quantity of the electron beam at a desired time and inject the electron beam in the ion trap.

MODES OF THE INVENTION

Hereinafter, a configuration and an operation of an anion generating and electron capture dissociation apparatus using cold electrons according to an exemplary embodiment of the present invention will be described in detail with reference to the accompanying drawings.

Figure 1:
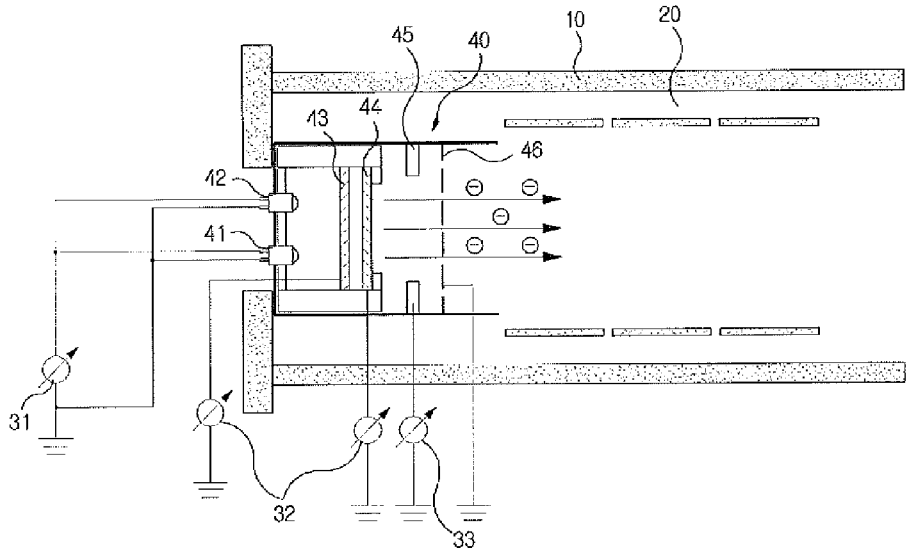
FIG. 1 is a view illustrating a configuration of an anion generating and electron capture dissociation apparatus using cold electrons according to an exemplary embodiment of the present invention.
Figure 2:
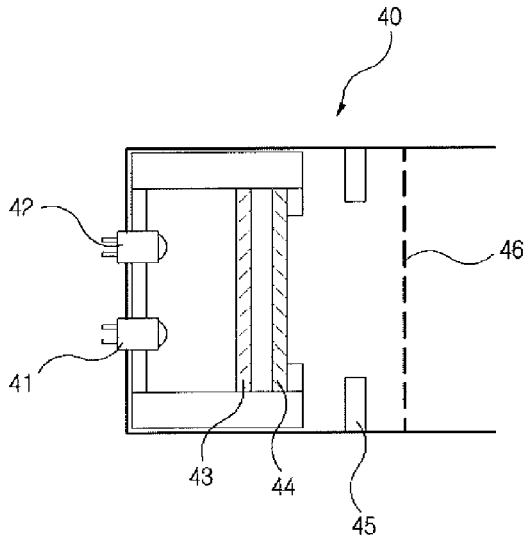
FIG. 2 is a detailed view illustrating a configuration of a cold electron generation module of FIG. 1.

FIG. 1 is a view illustrating an entire configuration of an anion generating and electron capture dissociation apparatus using cold electrons according to an exemplary embodiment of the present invention, and FIG. 2 is a detailed view illustrating a configuration of a cold electron generation module 40.

An anion generating and electron capture dissociation apparatus using cold electrons according to an exemplary embodiment of the present invention includes a plurality of ultraviolet diodes 41 and 42 configured to emit ultraviolet photons in a vacuum chamber 10 of a mass spectrometer, which is in a high vacuum state, micro-channel plate (MCP) electron multiplier plates 43 and 44 in which initial electron emission of the ultraviolet photons from the ultraviolet diodes 41 and 42 are induced and amplified through an front plate thereof, and a large quantity of electron beams are generated in a rear plate thereof, an electron focusing lens 45 configured to focus the electron beams amplified through the MCP electron multiplier plates 43 and 44, and a grid 46 configured to adjust energy and an electric current of electrons together with the electron focusing lens 45, an ion trap 20 configured of a plurality of electrodes to detect an ion injected through the grid 46, and power supplying devices 31, 32 and 33 configured to supply pulse power to each of the ultraviolet diodes 41 and 42, the MCP electron multiplier plates 43 and 44 and the electron focusing lens 45.

Here, at least one or more ultraviolet diodes 41 and 42 may be used.

An operation of the present invention as described above will be described in detail.

First, an emission time and an intensity of the ultraviolet photons generated from the ultraviolet diodes 41 and 42 are adjusted by the supplied on/off pulse signal of the power.

That is, as a continuous time of the pulse power supplied by the ultraviolet diode power supplying device 31 and a value of an electric current applied to the ultraviolet diodes 41 and 42 through the pulse power are controlled, the emission time and the intensity of the ultraviolet photons are controlled.

The ultraviolet photons generated from the ultraviolet diodes 41 and 42 are injected to the front plate 43 of the MCP electron multiplier plates 43 and 44, and amplified. Then, a large quantity of electrons (an amplification factor of $10^6$) is generated through the rear plate 44.

The election beam amplified through the rear plate 44 of the MCP electron multiplier plates 43 and 44 is focused according to a voltage value of the electron focusing lens 45, and moves toward the grid 46. The grid 46 forms an electric field which serves to adjust the energy and the electric current of the electron beam together with the electron focusing lens 45. When the voltage value of the grid 46 is lower than that of the MCP electron multiplier plate, the generated electrons have straightness and are injected into the ion trap 20.

The ion trap 20 is an open trap, and low energy electrons injected therein react with neutral molecules, induce negative ionization of the neutral molecules, undergo an ECD reaction by being coupled with cations having multiple positive charges, and inducing ion fragmentation. Thus, information on a structural analysis of the ions is provided.

In order to perform each operation of the MCP electron multiplier plates 43 and 44, the electron focusing lens 45 and the grid 46, which amplifies and focuses the ultraviolet photons generated from the ultraviolet diodes 41 and 42 and injects the ions having straightness into the ion trap 20, the inside of the vacuum chamber 10 should be maintained in a high vacuum state of $1\times10^{-7}$ to $1\times10^{-11}$ torr.

Figure 3:
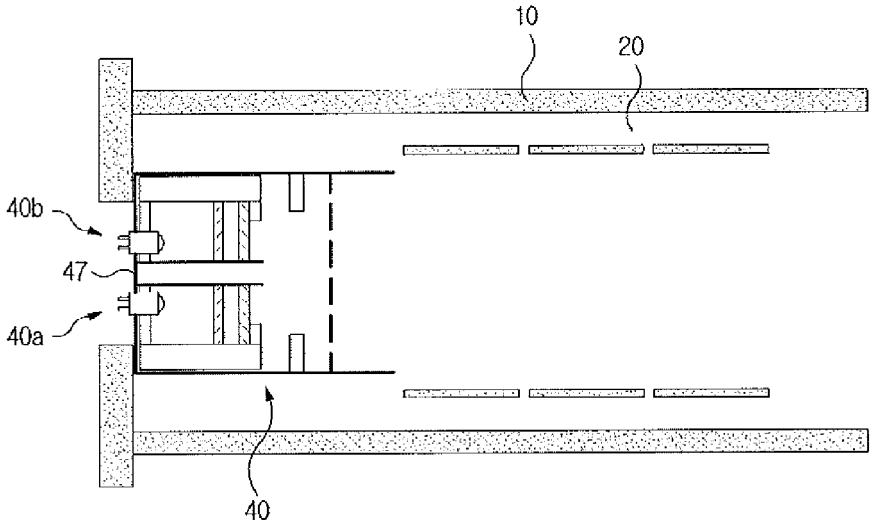
FIG. 3 is a view illustrating a configuration of an anion generating and electron capture dissociation apparatus using cold electrons when used together with an infrared multiple photon dissociation (IRMPD) device according to another exemplary embodiment of the present invention.
Figure 4:
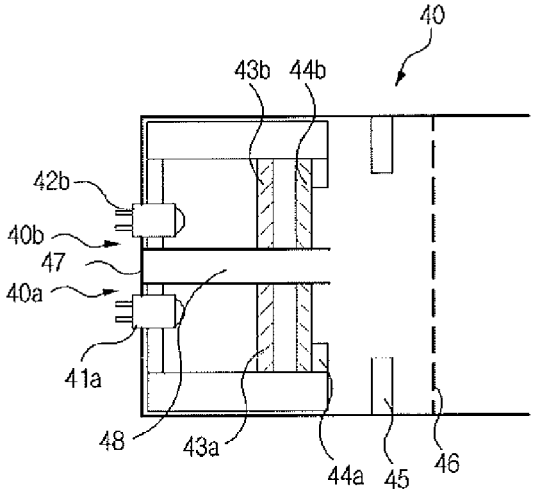
FIG. 4 is a detailed view illustrating a configuration of a cold electron generation module of FIG. 3.

FIG. 3 is a view illustrating a configuration of an anion generating and electron capture dissociation apparatus using cold electrons according to another exemplary embodiment of the present invention, and FIG. 4 is a detailed view illustrating a configuration of a cold electron generation module of FIG. 3. When used together with an infrared multiple photon dissociation (IRMPD) device, it is necessary to form a hole at a center of the MCP multiplier plate, such that infrared light may pass therethrough. And as illustrated in FIG. 4, cold electrons are generated from a surface of the MCP multiplier plate except for the central hole of the MCP multiplier plate.

Therefore, as illustrated in the drawings, the cold electron generation module 40 is divided into first and second cold electron generation modules 40*a* and 40*b*. Each of the first and second cold electron generation modules 40*a* and 40*b* includes ultraviolet diodes 41*a* and 42*a*, MCP electron multiplier plates 43*a*, 43*b*, 44*a* and 44*b*, an infrared light transmitting window 47 disposed between the divided first and second cold electron generation modules 40*a* and 40*b* to transmit external infrared light into the vacuum chamber 10, and an infrared light guide tube 48 configured to maintain a route of the infrared light passing through the infrared light transmitting window 47. A plurality of each of the ultraviolet diodes 41*a* and 42*a* may be provided.

Here, the infrared light transmitting window 47 is configured of a transparent window disposed between the atmosphere and the vacuum chamber 10 so that an infrared laser is transmitted into the vacuum chamber. Also, the infrared light transmitting window 47 is vacuum-sealed so that the vacuum chamber 10 is maintained in the vacuum state.

The infrared light guide tube 48 is formed in an elongated cylindrical nonconductive structure which is used as a pass route of the infrared light passing through the infrared light transmitting window 47. Also, the infrared light guide tube 48 serves to support each of structures of the cold electron generation modules 40*a* and 40*b*, and also prevents the cold electron generation modules 40*a* and 40*b* from being damaged by the infrared laser.

The ultraviolet photons generated from the first and second cold electron generation modules 40*a* and 40*b* inject cold electrons having straightness into the ion trap 20 through the electron focusing lens 45 and the grid 46.

Hereinafter, since specific operations of the divided first and second cold electron generation modules 40*a* and 40*b* are the same as those of the detailed description of FIGS. 1 and 2, reference will be made thereto.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. An anion generating and electron capture dissociation apparatus using cold electrons, which comprises a cold electron generation module configured to generate a large quantity of cold electrons from ultraviolet photons radiated into a mass spectrometer vacuum chamber which is in a high vacuum state, comprising:

a plurality of ultraviolet diodes configured to emit the ultraviolet photons in the mass spectrometer vacuum chamber;

a micro-channel plate (MCP) electron multiplier plates which induce and amplify initial electron emission of the ultraviolet photons from the ultraviolet diodes, and generate a large quantity of electron beams from a rear plate;

an electron focusing lens configured to focus the electron beams amplified through the MCP electron multiplier plates; and a grid configured to adjust energy and an electric current of the electron beams together with the electron focusing lens;

wherein the cold electron generation module is divided into a plurality of cold electron generation modules, and the divided cold electron generation modules are used together with an infrared multiple photon dissociation (IRMPD) device, the MCP electron multiplier plate comprising an infrared light transmitting window disposed between the divided cold electron generation modules to transmit external infrared light into the vacuum chamber, and an infrared light guide tube configured to maintain a route of the infrared light passing through the infrared light transmitting window.

2. The apparatus of claim 1, wherein the ultraviolet diodes control an emission time and an intensity of ultraviolet light according to an on/off pulse signal of supplied power.

3. The apparatus of claim 1, wherein the grid controls energy and an electric current of electrons generated from the MCP electron multiplier plate.

4. The apparatus of claim 1, wherein low energy electrons generated from the MCP electron multiplier plate react with neutral molecules and generate anions.

5. The apparatus of claim 1, wherein the cold electron generation module is divided into a plurality of cold electron generation modules, and each of the divided cold electron generation modules comprises the ultraviolet diodes and the MCP electron multiplier plate.

* * * * *